US012378974B2

(12) United States Patent
Brambilla

(10) Patent No.: US 12,378,974 B2
(45) Date of Patent: Aug. 5, 2025

(54) DAMPER FOR FAN

(71) Applicant: MUNTERS ITALY S.P.A., Chiusavecchia (IT)

(72) Inventor: Fulvio Brambilla, Sanremo (IT)

( * ) Notice: Subject to any disclaimer, the term of this patent is extended or adjusted under 35 U.S.C. 154(b) by 0 days.

(21) Appl. No.: 18/701,141

(22) PCT Filed: Oct. 12, 2022

(86) PCT No.: PCT/IB2022/059773
§ 371 (c)(1),
(2) Date: Apr. 12, 2024

(87) PCT Pub. No.: WO2023/062555
PCT Pub. Date: Apr. 20, 2023

(65) Prior Publication Data

US 2024/0352948 A1 Oct. 24, 2024

(30) Foreign Application Priority Data

Oct. 14, 2021 (EP) ..... 21425050

(51) Int. Cl.
*F04D 29/66* (2006.01)
*F04D 19/00* (2006.01)
*F04D 29/54* (2006.01)

(52) U.S. Cl.
CPC ..... *F04D 29/668* (2013.01); *F04D 29/547* (2013.01); *F04D 19/002* (2013.01)

(58) Field of Classification Search
CPC ..... F04D 25/14; F04D 29/547; F04D 29/703
See application file for complete search history.

(56) References Cited

U.S. PATENT DOCUMENTS 4,146,048 A * 3/1979 McCabe ..... F16K 17/386 29/434
11,692,734 B2 * 7/2023 Santucci ..... F24F 13/10 126/299 D (Continued)

FOREIGN PATENT DOCUMENTS

| | | |
|---|---|---|
| EP | 3 037 673 A1 | 6/2016 |
| JP | 2002-130182 A | 5/2002 |
| JP | 2008-128591 A | 6/2008 |

OTHER PUBLICATIONS

Extended European Search Report dated Mar. 22, 2022, in European Patent Application No. 21425050.8.

(Continued)

*Primary Examiner* — Brian O Peters
(74) *Attorney, Agent, or Firm* — Venable LLP

(57) ABSTRACT

A damper for fan includes a frame (61) defining a passage for an airflow, having an inlet and an outlet, and a pair of flaps (62, 63) hinged to the frame (61) about respective rotation axes (x1, x2) parallel to each other, the flaps being rotatable between an open and a closed position, for opening and closing the passage, respectively. Each of the flaps includes a concave portion (62*c*, 63*c*) and a convex portion (62*d*, 63*d*) arranged on opposite axial halves of the respective flap, wherein in the closed position the concave portion (62*c*, 63*c*) has a concavity facing the inlet of the passage and a convexity facing the outlet of the passage, and the convex portion (62*d*, 63*d*) has a convexity facing the inlet of the passage and a concavity facing the outlet of the passage, and wherein the concave portion (62*c*) and the convex portion (62*d*) of one of the flaps have an axial arrangement reversed with respect to the concave portion (63*c*) and the convex portion (63*d*) of the other flap.

7 Claims, 12 Drawing Sheets

(56) References Cited

U.S. PATENT DOCUMENTS

| | | | | |
|---|---|---|---|---|
| 2006/0286924 | A1* | 12/2006 | Milana | F24F 7/007 454/259 |
| 2013/0051999 | A1 | 2/2013 | Wenger et al. | |
| 2019/0242405 | A1* | 8/2019 | Holt | F04D 29/524 |

OTHER PUBLICATIONS

International Search Report dated Jan. 5, 2023, in International Application No. PCT/IB2022/059773.

* cited by examiner

DAMPER FOR FAN

This invention relates generally to the field of axial fans, of the type provided with a damper that intercepts the passage of fluid in the duct of the fan. More particularly, this invention relates to a damper for a fan.

Exhaust fans provided with a conical exhaust duct arranged downstream of the impeller of the fan are known. Said duct is associated with a damper comprising a pair of flaps rotating about their respective rotation axes which are parallel to each other. These flaps are rotatable between an open and a closed position, in which the damper respectively opens and closes a passage defined in the duct. Conventional flat flaps have a negative effect on the fluid dynamic efficiency of the system, and consequently result in a significant pressure drop. Moreover, their opening may be inefficient under certain conditions of use.

One object of this invention is to provide a fan damper capable of at least partially resolving the aforesaid drawbacks.

In view of this object, a subject matter of the invention is a fan damper comprising

- a frame defining a passage for an airflow, having an inlet and an outlet, and
- a pair of flaps hinged to the frame about respective rotation axes which are parallel to each other, said flaps being rotatable between an open and a closed position, respectively for opening and closing the passage,
- characterized in that each of said flaps comprises a concave portion and a convex portion arranged on opposite axial halves of the respective flap, wherein in the closed position said concave portion has a concavity facing the inlet of the passage and a convexity facing the outlet of the passage, and said convex portion has a convexity facing the inlet of the passage and a concavity facing the outlet of the passage, and wherein the concave portion and the convex portion of one of said flaps have an inverted axial arrangement with respect to the concave portion and the convex portion of the other of said flaps.

The curved profile of the flaps, defined according to the direction of rotation of the impeller of the fan, improves the fluid dynamics of the airflow and reduces turbulence, having the final effect of a lower pressure drop caused by the damper.

A further subject matter of the invention is a damper for a fan, comprising

- a frame defining a passage for an airflow, having an inlet and an outlet, and
- a pair of flaps hinged to the frame about respective rotation axes parallel to each other, said flaps being rotatable between an open and a closed position, respectively for opening and closing the passage,
- characterized in that the flaps (62, 63) are shaped in such a way as to define between them, in the open position, a slit for the passage of air arranged at the rotation axes of the pair of flaps and having a width d whereby $0.01 \cdot D \leq d \leq 0.1 \cdot D$, where D is the outer diameter or width of the damper.

The distance between the rotation axes of the flaps thus determines a slit that allows a portion of the airflow generated by the impeller to pass, creating a negative jump in static pressure that facilitates the complete opening of the flaps when the fan is in motion.

Preferred embodiments of the invention are defined in the dependent claims, which are to be understood as an integral part of this description.

The invention covers both dampers made as a separate element that is mounted on a fan assembly and dampers that are integrated into said fan assembly. In the latter case, the frame of the damper may consist of the same casing that encloses the impeller of the fan, or the conical exhaust duct.

Although the invention was conceived in connection with a damper arranged downstream of an exhaust fan, it may find use in other circumstances where there is a need to reduce the pressure drop produced by the damper and/or improve the opening efficiency of the flaps.

Further features and advantages of the damper according to the invention will become clearer from the following detailed description of an embodiment of the invention, made in reference to the accompanying drawings, provided purely for illustrative and non-limiting purposes, wherein.

Figure 3:
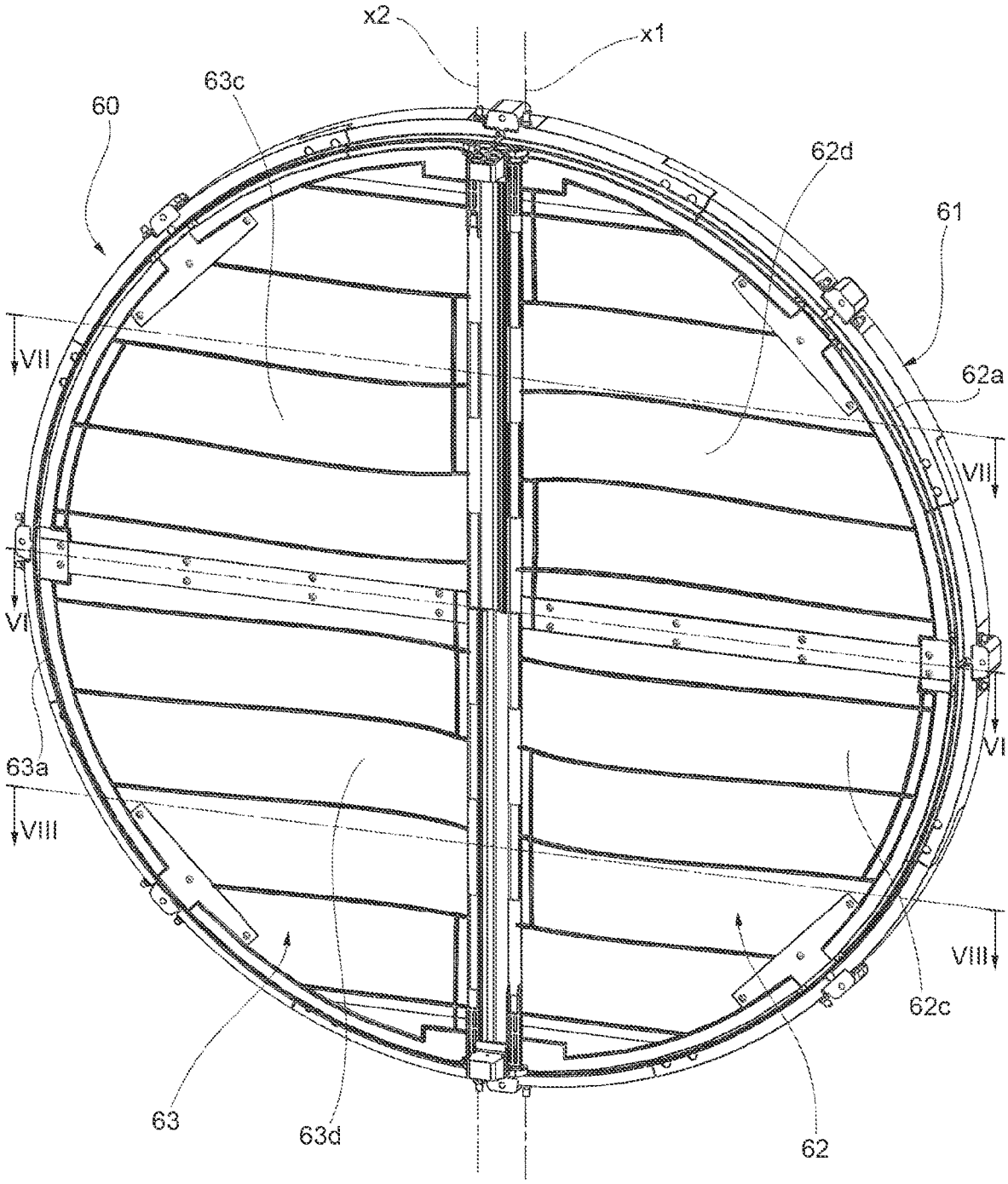
FIG. 3 through 5 are perspective views of the fan damper in FIG. 1, in the open position, intermediate position, and closed position, respectively.
Figure 6:
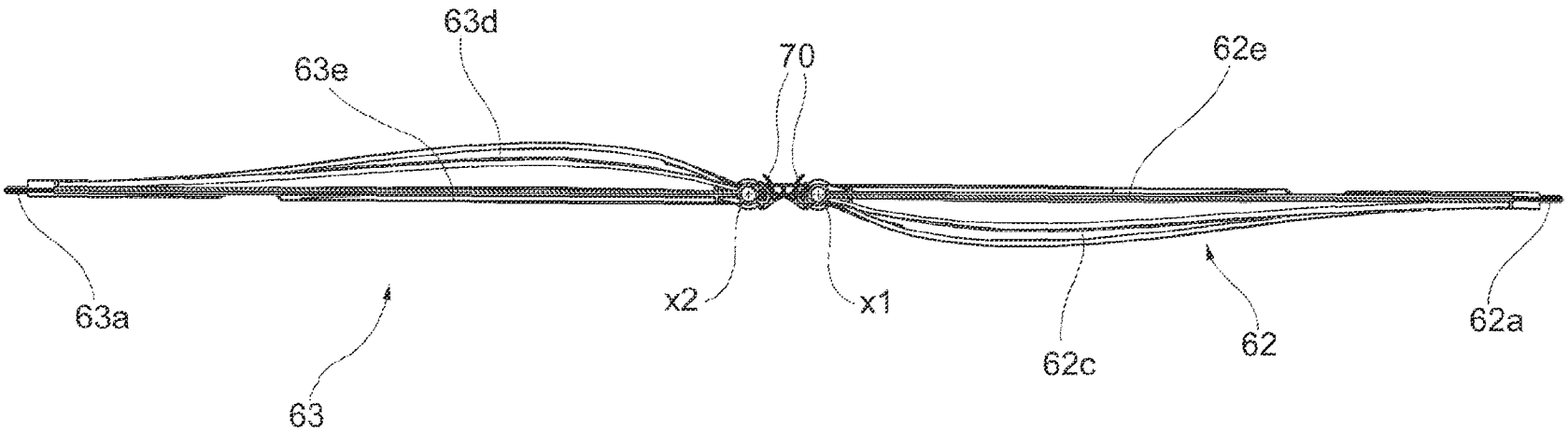
Figure 7:
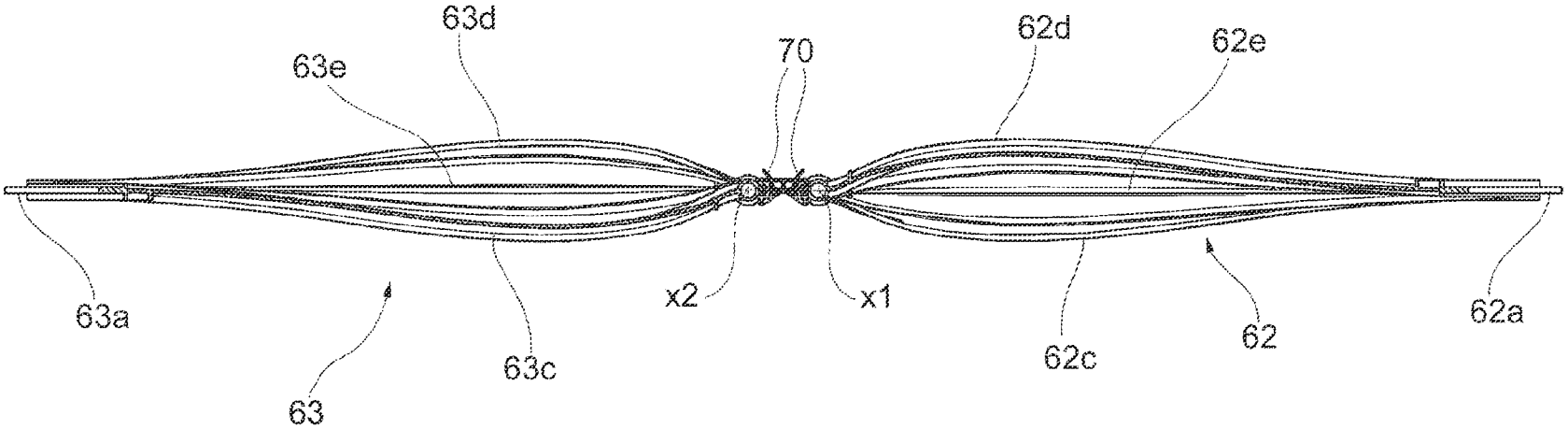
Figure 8:
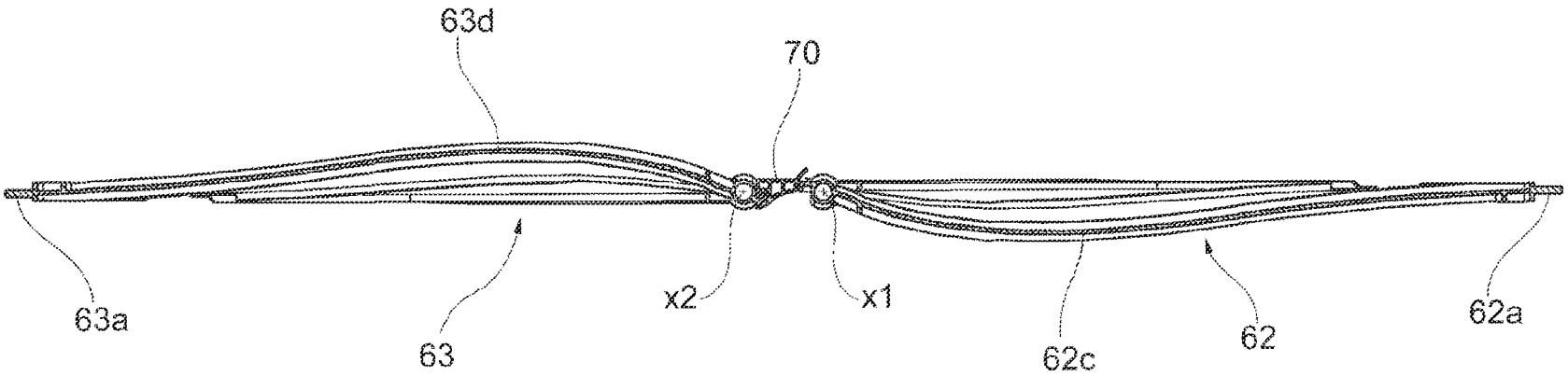
Figure 9:
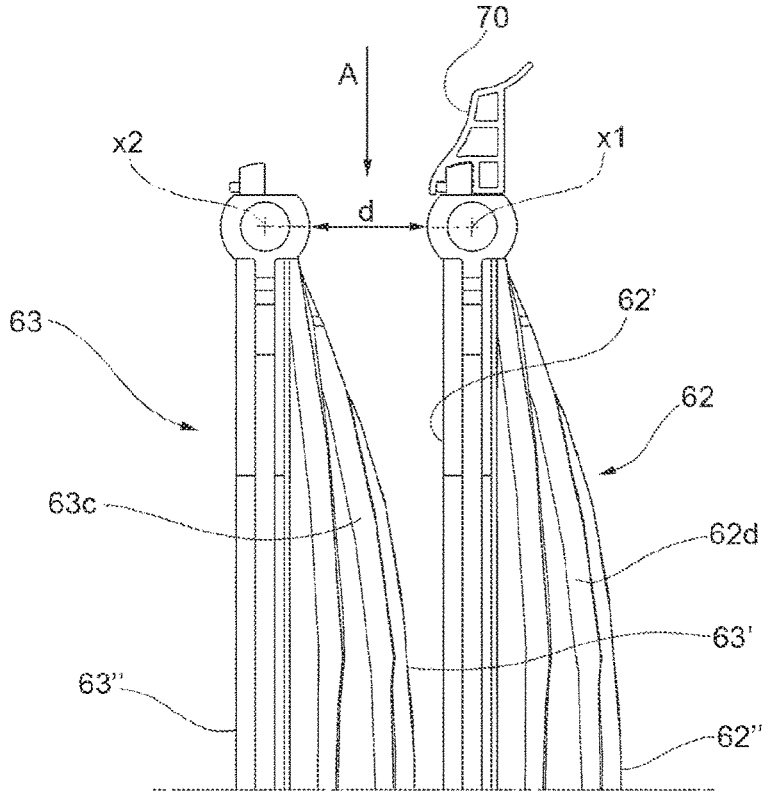
Figure 10:
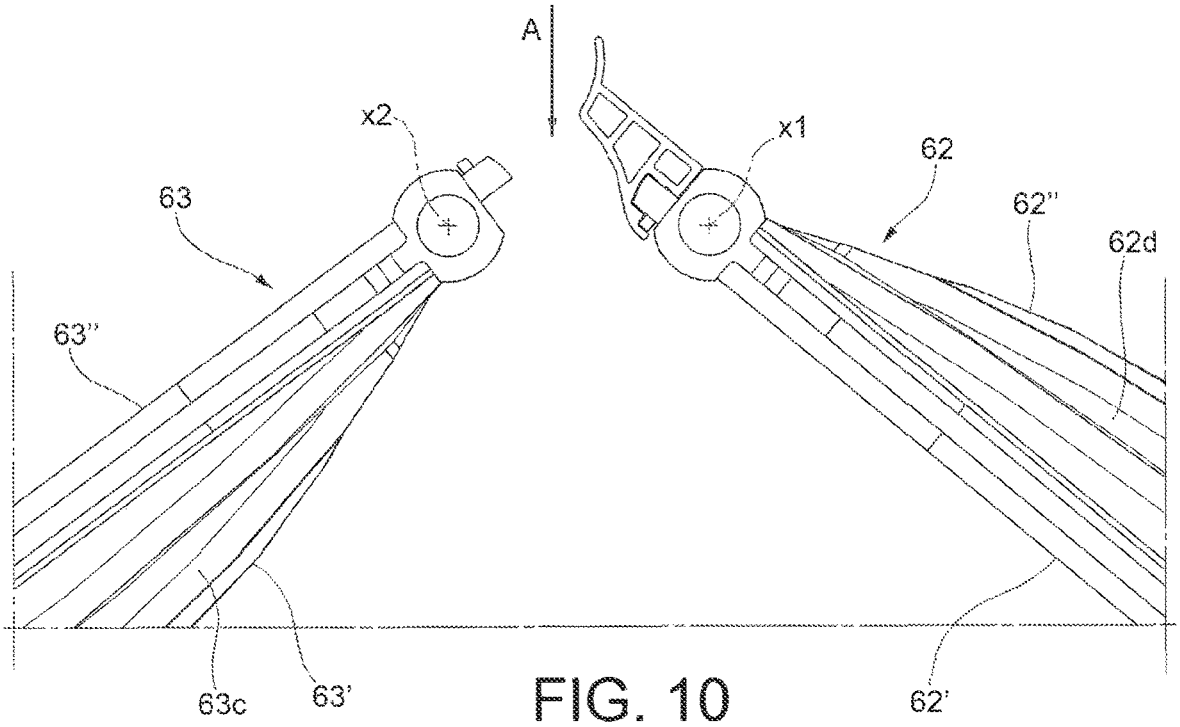
Figure 11:
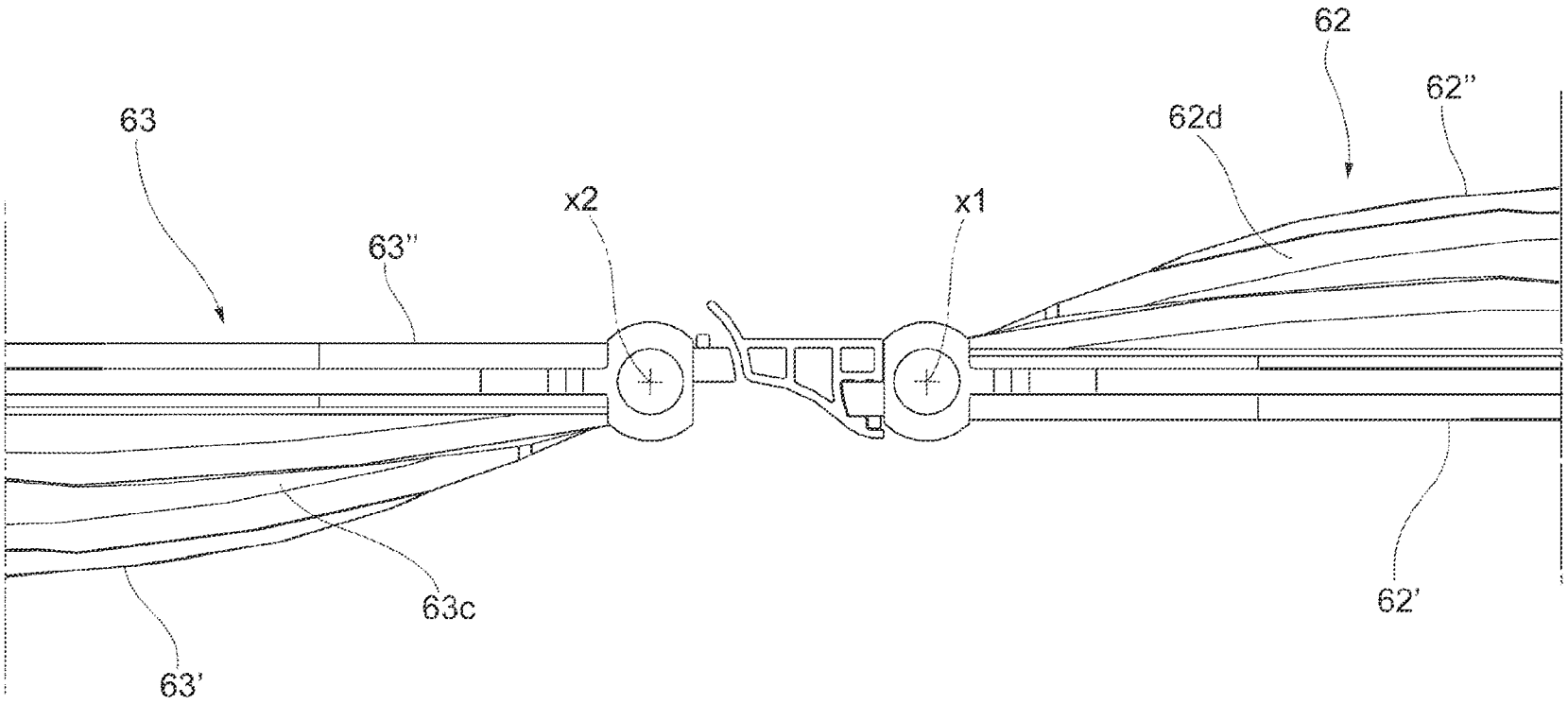
Figure 11A:
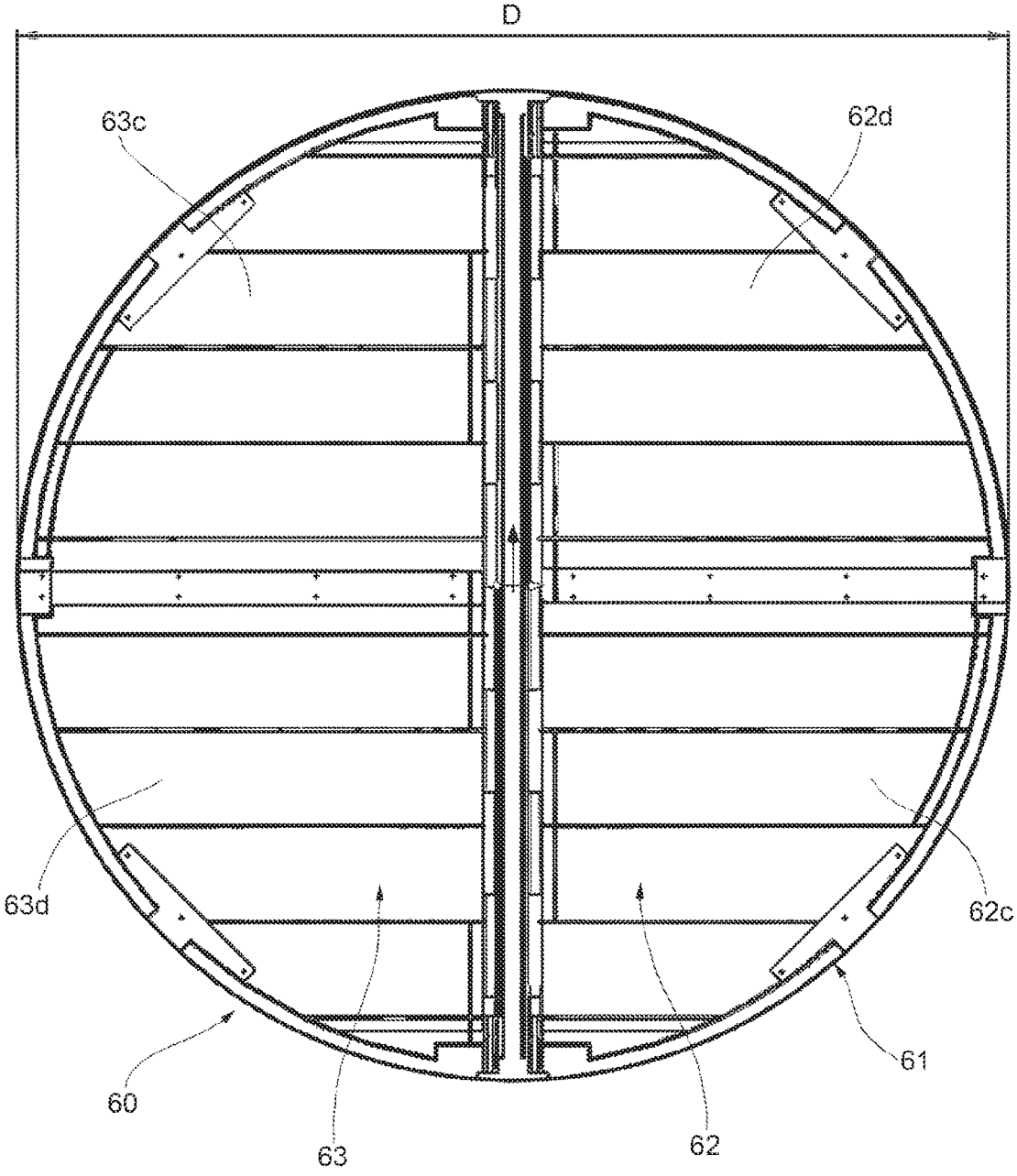
Figure 12:
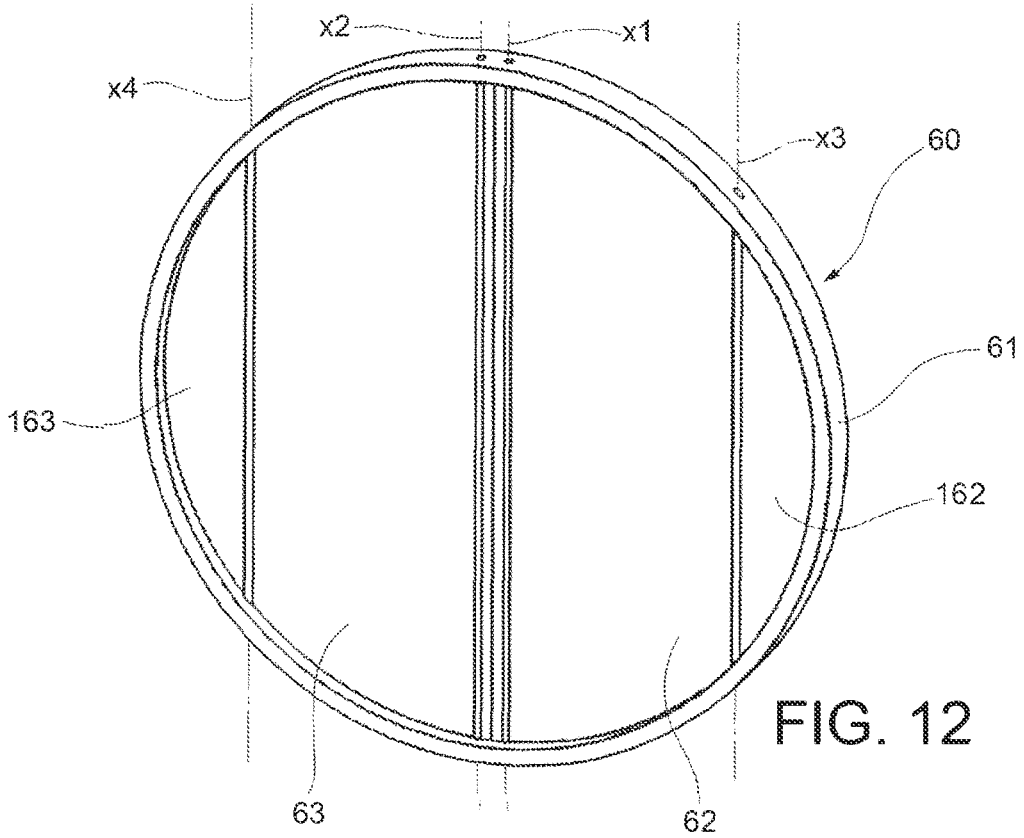
Figure 13:
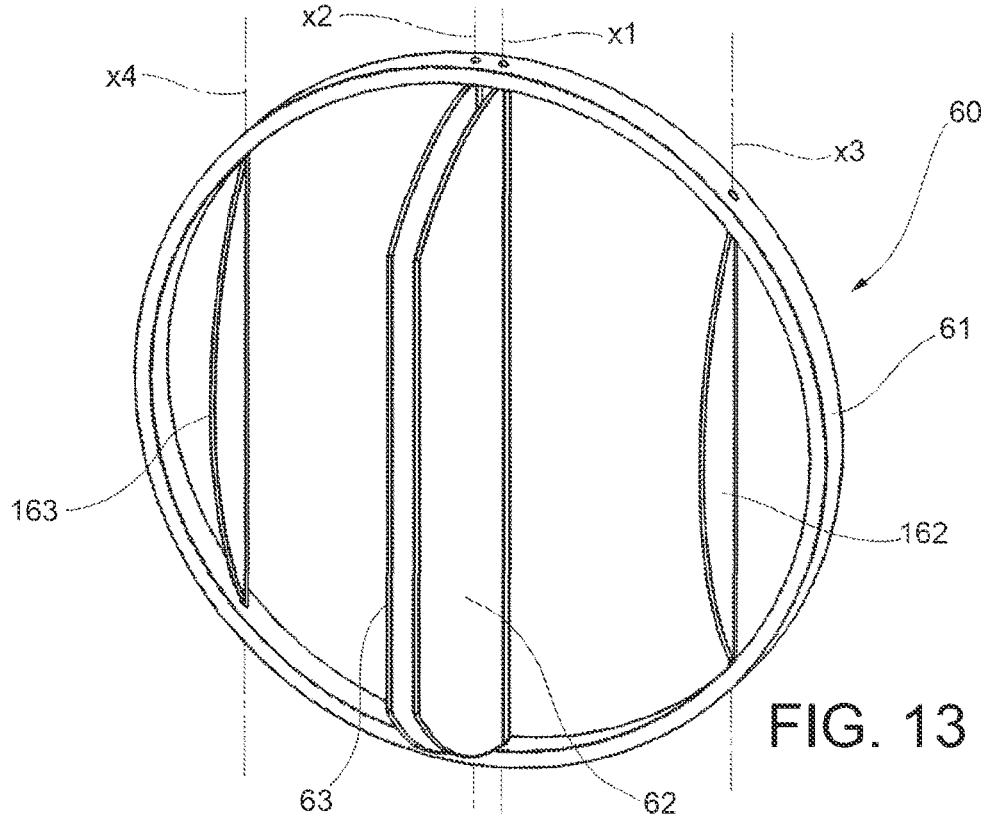

FIG. 6 is a horizontal sectional view of the damper flaps, taken along the line VI-VI of FIG. 3, FIG. 7 is a horizontal sectional view of the damper flaps, taken along the line VII-VII of FIG. 3, FIG. 8 is a horizontal sectional view of the damper flaps, taken along the line VIII-VIII of FIG. 3, FIG. 9 through 11 are plan views and enlarged scale views of a detail of the damper flaps in the open position, intermediate position, and closed position, respectively, FIG. 11*a* is a front view of the damper, FIGS. 12 and 13 are perspective views of a damper variant in the closed position and open position, respectively.

Figure 1:
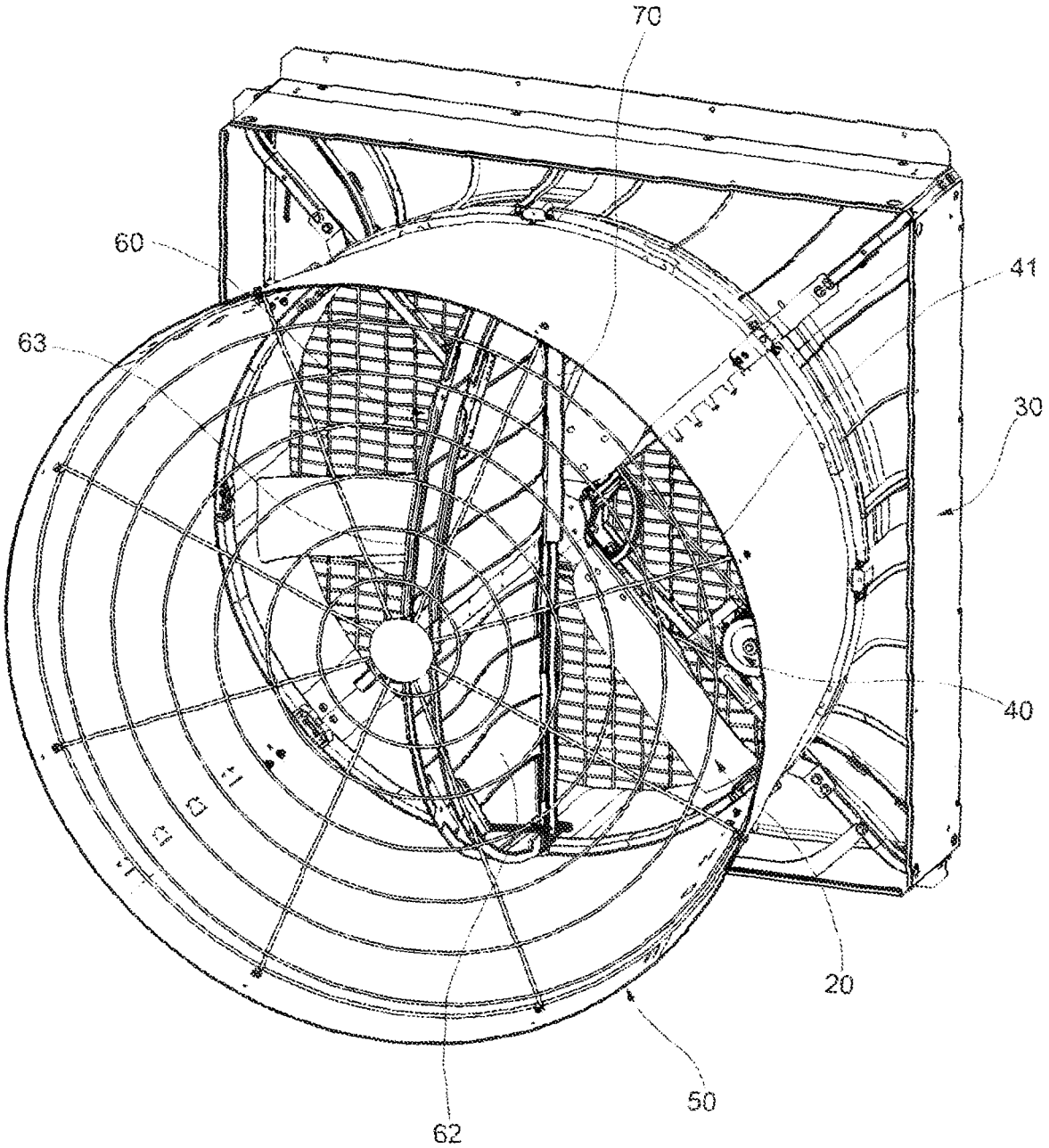
FIG. 1 is a perspective view of a fan provided with a damper according to the invention.
Figure 2:
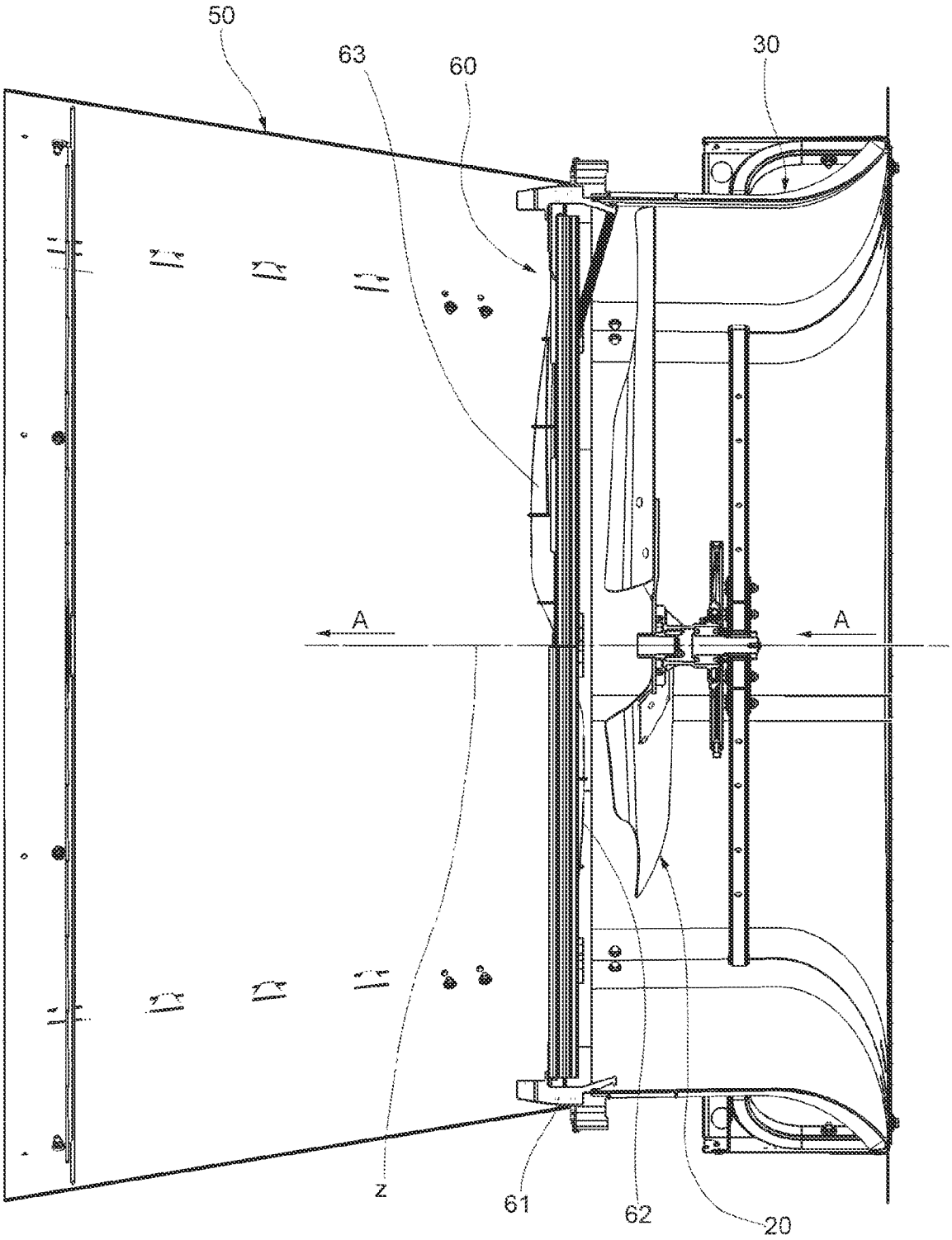
FIG. 2 is a vertical sectional view, passing through the rotation axis of the fan in FIG. 1.

FIGS. 1 and 2 illustrate a fan, conventionally comprising an impeller 20 rotatably supported within an enclosure or conveyor 30, and driven to rotate by a motor 40, such as via a drive belt 41. The rotation axis of the impeller 20 is indicated with z in FIG. 2. The fan in question, which is in particular an exhaust fan, further comprises a conical exhaust duct 50 arranged downstream of the impeller 20, i.e., on the exhaust side thereof. The arrows A in FIG. 2 represent the overall direction of airflow generated by the impeller 20.

The fan further comprises a damper 60, which in the example shown is arranged downstream of the impeller 20, i.e., on the exhaust side thereof. In other embodiments not shown, the damper could be arranged upstream of the impeller, i.e., on the suction side thereof. In the illustrated example, the damper 60 is interposed between the impeller 20 and the conical exhaust duct 50.

Figure 4:
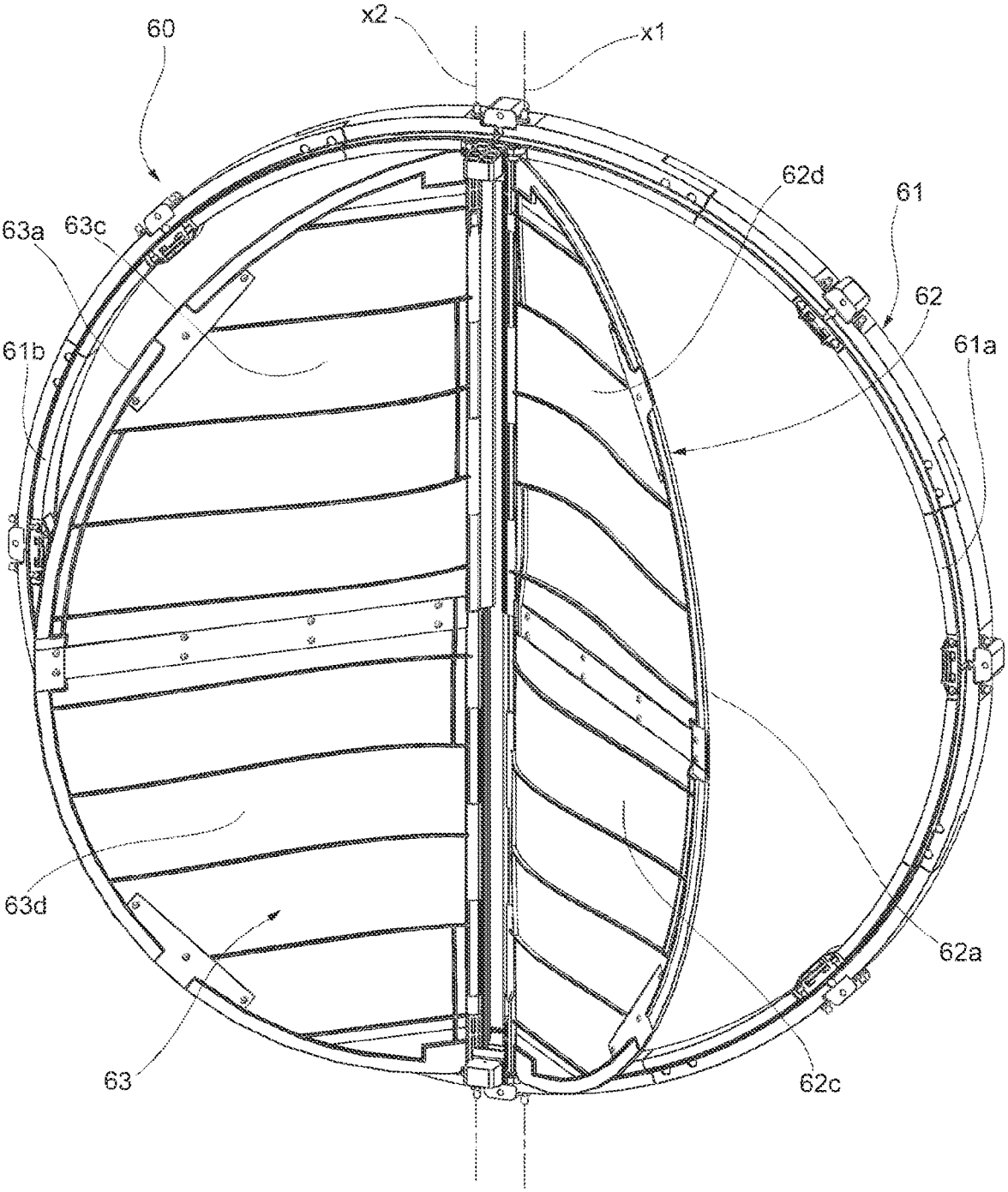
Figure 5:
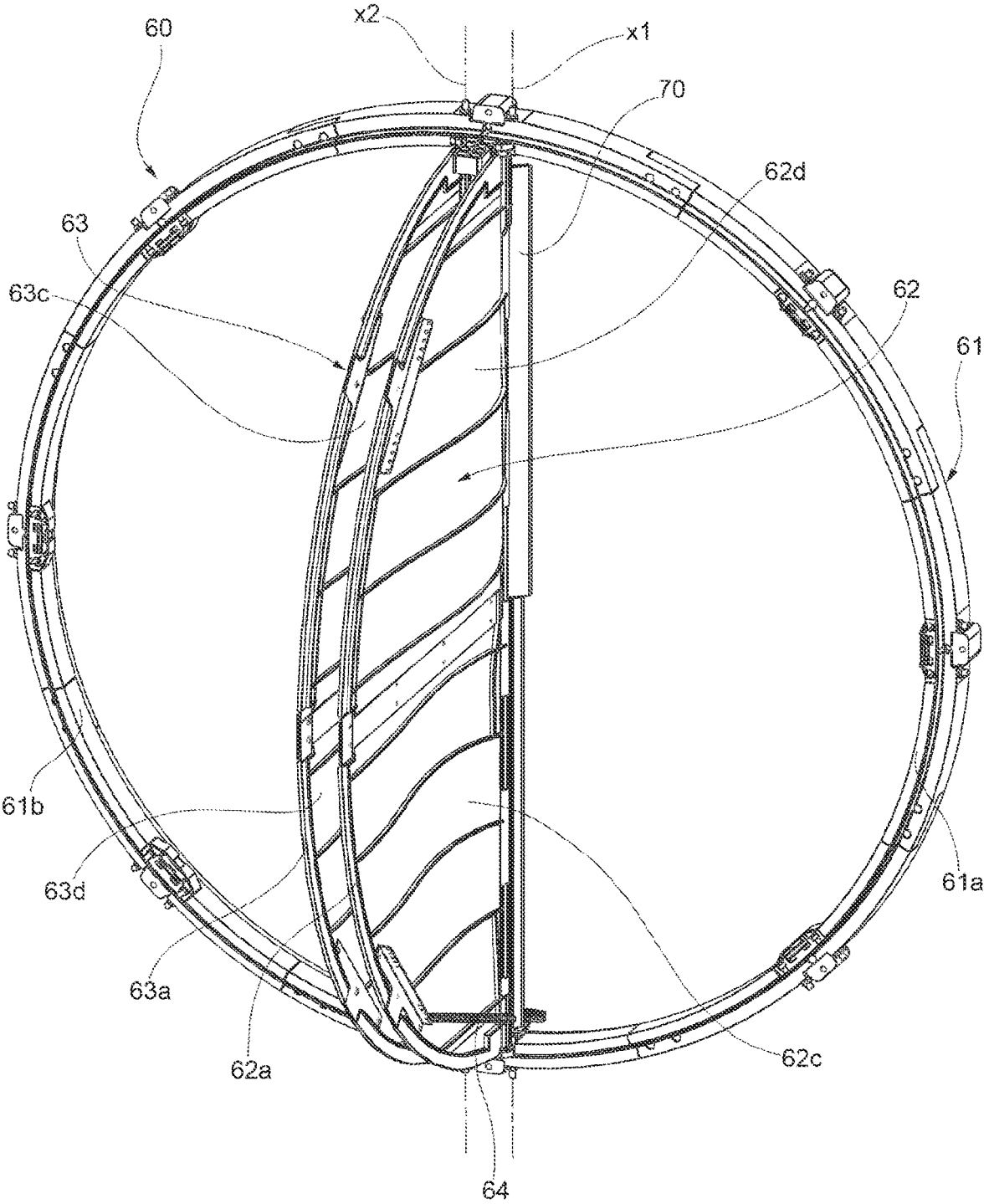

The damper 60 is shown individually in FIG. 3 through 5. The damper 60 comprises a frame 61, which in the illustrated example has a circular ring shape. Thus, the frame 61 defines an airflow passage A having an inlet and an outlet respectively upstream and downstream of the damper 60 according to the direction of the airflow A. In the illustrated example, the inlet of said passage faces the impeller 20, and the outlet faces the conical exhaust duct 50.

The damper 60 also comprises a pair of flaps 62, 63 hinged to the frame 61 about respective rotation axes x1, x2 parallel to each other. The flaps 62, 63 are rotatable between an open position (shown in FIG. 5) and a closed position (shown in FIG. 3), respectively for opening and closing the passage defined in the damper 60. The rotation axes x1, x2 of the flaps are arranged near each other and near the center of the passage defined by the damper 60. In the open position, the flaps 62, 63 are arranged substantially orthogonally to the plane defined by the frame 61 of the damper. In the closed position, the edge 62*a*, 63*a* of each flap 62, 63 engages the edge 61*a*, 61*b* of a respective half of the frame 61 of the damper. In the illustrated example, the rotation axes x1, x2 of the flaps 62, 63 are arranged vertically. In other embodiments not shown, the rotation axes of the flaps may have different orientations, such as horizontal.

In the illustrated example, as will be explained below, the transition of the flaps 62, 63 from the closed position to the open position occurs by the direct effect of the thrust exerted by the airflow generated by the impeller 20. Therefore, in order to achieve the transition from the open position to the closed position of the flaps 62, 63 when the impeller 11 is stopped, return means using gravity and/or elastic forces may be provided. In the illustrated example, respective return springs (only one of which is visible in the figures and indicated by 64) are provided for returning the flaps 62, 63 into the closed position, which are connected on one side to the flaps and on the other side to the frame 61. According to alternative embodiments, not shown, the actuation to open and/or close the flaps may take place by means of actuator devices or mechanisms. According to other embodiments, the flaps 62, 63 may be connected to each other by a transmission gear, so as to ensure the synchronous movement of the flaps.

As may be seen particularly in FIG. 3 through 8, the flaps 62, 63 are not flat, but rather have a curvilinear profile. In FIG. 6 through 8, the profile of the flaps 62, 63 in the sectional plane is shown with a dashed line. Each of the flaps 62, 63 comprises a concave portion (concave portions indicated with 62*c* and 63*c*) and a convex portion (convex portions indicated with 62*d* and 63*d*) arranged on opposite axial halves of the respective flap 62, 63. In the closed position of FIG. 3, the concave portions 62, 63*c* have a concavity facing the inlet of the passage defined by the damper 60 (i.e., toward the impeller 20) and a convexity facing the outlet of said passage (i.e., toward the conical exhaust duct 50), and the convex portions 62*d*, 63*d* have a convexity facing the inlet of the passage defined by the damper 60 and a concavity facing the outlet of said passage. The concave portion 62*c* and the convex portion 62*d* of the flap numbered with 62 have an inverted axial arrangement with respect to the concave portion 63*c* and the convex portion 63*d* of the other flap, numbered with 63. In other words, the concave and convex portions of the two flaps are arranged in a "checkerboard" pattern, i.e., alternating in the two directions orthogonal to the rotation axis of the impeller. In the illustrated example, the lower half of the right flap 62 makes up the concave portion 62*c* of said flap, and the upper half of said flap 62 makes up the convex portion 62*d* of said flap. Inversely, the upper half of said left flap 63 makes up the concave portion 63*c* of said flap, while the lower half of said flap 63 makes up the convex portion 63*d* of said flap. This arrangement is adapted to the rotation direction of the impeller 20, which in the illustrated example is clockwise taking FIG. 1 as reference. If the rotation direction of the impeller were counterclockwise, then the arrangement of concave and convex portions would have to be reversed with respect to the example shown.

The advantage over conventional flat flaps is obvious; since the flow exiting the impeller 20 is turbulent and helical, a flat flap creates "dead areas" where the flow does not brush the surface but "bounces," interfering negatively with the surfaces of the divergent cone. The concavities and convexities, arranged according to the rotation direction of the impeller, facilitate the "adherence" of the flow to the surfaces making the exhaust of the outgoing air less disturbed, considering that this is also strongly conditioned by the divergent cone that further contributes to modifying the flow lines. This on the one hand allows for an efficient opening of the flaps (specifically for flaps driven by the thrust of the airflow), because when they are close to the final open position a negative pressure delta is created by the airflow adhering to the flap surfaces and greater than that which would be created by a flat flap, which creates a stronger suction that holds the flaps in the open position. In addition, with respect to the flat flaps, there is a lower pressure drop when the flaps are open, which is advantageous both for flaps driven by the thrust of the airflow and for those driven by actuators.

Note that the concavities and convexities are obtained within each individual flap 62, 63, while the profile of the flap 62, 63 at its perimeter, and particularly at the outer edge 62*a*, 63*a*, is flat. The concave portion 62*c*, 63*c* and the convex portion 62*d*, 63*d* of each of the flaps 62, 63 are also connected to each other by a flat intermediate portion 62*e*, 63*e* lying substantially in the same plane as the outer edge 62*a*, 63*a* of the flap 62, 63.

In addition to, or as an alternative to, the arrangement of concave and convex portions on the flaps, the flaps 62, 63 are shaped so as to define therebetween, in the open position, a slit for the passage of air arranged at the rotation axes x1 and x2 of the flaps 62, 63 and having a width d whereby $0.01 \cdot D \leq d \leq 0.1 \cdot D$, where D is the outer diameter or width of the damper (see in particular FIGS. 9 to 11 and 11*a*). This allows some of the airflow to flow between the inner surfaces 62', 63' of the two flaps when they are near to the final open position. The different air velocity between the outer 62", 63" and inner 62', 63' surfaces of the flaps creates a negative pressure delta that tends to suck the two flaps toward each other as they approach each other. The gap is sized in such a way as to prevent this flow rate from being either excessive or low, because in either case the "suction" effect would be inefficient. The width d of the slit is measured on the line joining the rotation axes x1, x2 of the two flaps. It is not required for this width to be constant along the entire slit between the flaps 62, 63; it is sufficient for the slit to satisfy the relationship $0.01 \cdot D \leq d \leq 0.1 \cdot D$ along most of its longitudinal extension.

On the edges of the flaps 62, 63 at the rotation axes x1 and x2 closing elements 70 are arranged, which close the gap between the two flaps in the closed position. Such closure elements 70 are designed to disturb as little as possible the fluid dynamics or aerodynamics of the impeller 20 in the open position of the flaps 62, 63. Said closing elements 70 must also prevent a minimum interference therebetween from leading to the blocking of the rotation of the flaps, since the movement of these is not synchronous when the relative movement is obtained by the thrust of the airflow. The design is therefore conceived so that even in the case of contact, there is still only a little bit of rolling friction.

A variant of the damper is described with reference to FIGS. 12 and 13. Elements corresponding to those described thus far will be assigned the same numerical references. Said variant differs from the embodiment described above in that the flaps 62, 63 are shaped to only partially close the passage for the airflow. Therefore, additional flaps 162, 163, hereinafter also referred to as secondary flaps, are provided, which are hinged to the frame 61 about respective rotation axes x3, x4 parallel to the rotation axes of the main flaps 62, 63. Each of the secondary flaps 162, 163 is connected respectively to one of the main flaps 62, 63 via a transmission gear (not shown) whereby there is a synchronous movement between each secondary flap 162, 163 and the respective main flap 62, 63. The flaps 62, 162, 63, 163 are rotatable between a closed position (shown in FIG. 12) and an open position (shown in FIG. 13), respectively for opening and closing the passage defined in the damper 60. According to a further embodiment, the secondary flaps 162, 163 may be disconnected from the main flaps 62, 63 to realize a movement that is not synchronous with that of the main flaps 62, 63. In this case, return means associated with the secondary flaps 162, 163 may be provided, such as additional return springs.

For simplicity of representation, the main flaps 62, 63 have been shown flat in FIGS. 12 and 13. However, it is understood that they may have the curvilinear profile and/or the gap between the main flaps 62, 63 in a manner similar to that described in relation to the previous embodiment.

I claim:

1. A damper for fan comprising:

a frame defining a passage for an airflow, having an inlet and an outlet; and a pair of flaps hinged to the frame about respective rotation axes which are parallel to each other, said flaps being rotatable between an open and a closed position, for the opening and the closing of said passage, respectively, wherein each of said flaps comprises a concave portion and a convex portion arranged on opposite axial halves of said respective flap, wherein in the closed position said concave portion has a concavity facing the inlet of said passage and a convexity facing the outlet of said passage, and said convex portion has a convexity facing the inlet of said passage and a concavity facing the outlet of said passage, and wherein the concave portion and the convex portion of one of said flaps have an inverted axial arrangement with respect to said concave portion and said convex portion of the other of said flaps.

2. The damper according to claim 1, wherein the rotation axes of the flaps are arranged proximate each other and proximate the center of said passage, wherein in the open position, the flaps are arranged substantially orthogonal to the plane defined by said frame of the damper, and wherein in the closed position, the outer edge of each flap engages the edge of a respective half of said frame.

3. The damper according to claim 2, wherein the outer edge of each of said flaps has a flat profile.

4. The damper according to claim 1, wherein the flaps are shaped in such a way as to define therebetween, in the open position, a slit for the passage of air arranged at the rotation axes of the pair of flaps and having a width d whereby $0.01 \cdot D \leq d \leq 0.1 \cdot D$, where D is the outer diameter or width of the damper.

5. A fan comprising a damper according claim 1, wherein the rotation axes of the flaps are arranged vertically.

6. The fan according to claim 5, further comprising an impeller, wherein said pair of flaps is driven to open by the dynamic air pressure generated by the impeller.

7. The fan according to claim 6, further comprising a conical exhaust duct arranged downstream of the impeller, wherein the damper is located between the impeller and the conical exhaust duct.

* * * * *